US008122693B1

(12) United States Patent
Buchko

(10) Patent No.: US 8,122,693 B1
(45) Date of Patent: Feb. 28, 2012

(54) LAYERED, ADHESIVE CONSTRUCTION FOR TOOLING COMPONENTS OF A PACKAGING MACHINE

(75) Inventor: Raymond G. Buchko, Neenah, WI (US)

(73) Assignee: CP Packaging, Inc., Appleton, WI (US)

( * ) Notice: Subject to any disclaimer, the term of this patent is extended or adjusted under 35 U.S.C. 154(b) by 71 days.

(21) Appl. No.: 12/271,535

(22) Filed: Nov. 14, 2008

(51) Int. Cl.
*B65B 47/10* (2006.01)

(52) U.S. Cl. ..... 53/559; 53/453; 53/574; 493/85; 493/211

(58) Field of Classification Search ..... 53/111 R, 53/433, 559, 574, 453, 428, 432, 510, 511; 493/51, 52, 84, 85, 186, 210, 211
See application file for complete search history.

(56) References Cited

U.S. PATENT DOCUMENTS

| | | | | |
|---|---|---|---|---|
| 2,506,678 | A * | 5/1950 | Osgood, Jr. | 162/347 |
| 2,534,684 | A * | 12/1950 | Serpico | 217/65 |
| 3,442,412 | A * | 5/1969 | Munroe | 217/69 |
| 3,767,349 | A * | 10/1973 | Jezuit | 425/387.1 |
| 4,113,557 | A * | 9/1978 | Kankaanpaa | 162/301 |
| 4,695,044 | A * | 9/1987 | Nishihama et al. | 269/21 |
| 5,076,894 | A * | 12/1991 | Simmons et al. | 162/352 |
| 6,305,768 | B1 * | 10/2001 | Nishimoto | 312/406 |
| 7,340,871 | B1 * | 3/2008 | Shackelford et al. | 53/453 |
| 7,607,279 | B2 * | 10/2009 | Shackelford et al. | 53/453 |

* cited by examiner

*Primary Examiner* — Christopher Harmon
(74) *Attorney, Agent, or Firm* — Boyle Fredrickson, S.C.

(57) ABSTRACT

A forming tool usable with a packaging machine utilizes adhesive bonds rather than weld joints or fasteners to interconnect structural components of the forming tool. Using adhesive rather than weld joints and mechanical fasteners provides smooth interfaces thereby reducing the collection of bacteria, germs and cleaning residue on the surfaces of the forming tool, which is particularly advantageous for forming tools used with packing machines used in sanitary environments, such as for food or pharmaceutical packaging.

12 Claims, 6 Drawing Sheets

LAYERED, ADHESIVE CONSTRUCTION FOR TOOLING COMPONENTS OF A PACKAGING MACHINE

BACKGROUND AND SUMMARY OF THE INVENTION

This invention relates to a packaging machine, and more particularly to a sanitary construction for various components of a packaging machine.

Equipment used in sanitary environments, such as in the handling of food products or pharmaceuticals, must frequently be washed down or sanitized for product safety. In such equipment, it is desirable that the construction and assembly details are such as to avoid areas in which particulate material can build up. Accordingly, components or connectors that include recesses, pockets, crevices or the like, such as set screws, socket head cap screws, etc. should be avoided. However, connectors of this type are commonly employed in the construction of such machinery components. In addition, welding of such components is also not desirable because welded joints include pockets or cracks in which particulate matter can become trapped.

It is an object of the present invention to provide a construction for certain components of equipment for use in a sanitary environment which does not include the use of undesirable welds, connectors or the like. It is a further object of the invention to provide such a construction in which the various parts of the components are securely and permanently interconnected together. Yet another object of the invention is to provide such a construction which allows components to be assembled together in layers so as to provide internal chambers, recesses or passages which are unobstructed.

The present invention contemplates a forming tool usable with a packaging machine in which adhesive rather than weld joints or fasteners are used to assemble the components of the forming tool. Using adhesive rather than weld joints and mechanical fasteners provides smooth, crevice-free and pocket-free interfaces between the various components of the forming tool. Such smooth interfaces are less prone to germ and other bacteria collection that can affect the sterility of the packaging machine, which is particularly advantageous for packaging machines used in sanitary environments, such as for food or pharmaceutical packaging. The forming tool is adapted to removably engage a receiver of the packaging machine. This removability allows different forming tools to be mounted to the receiver as packaging needs or conditions change.

Therefore, in accordance with one aspect of the invention, an apparatus for use with a packaging system includes a base plate adapted to be received by a receiver of the packaging system. A box is coupled to the base plate and has a set of frame members coupled to the base plate. The set of frame members and the base plate define an interior volume accessible from an opening normal to the base plate. The box is coupled to the base plate by a bonding agent. In a further aspect, the bonding agent is a water resistant epoxy. In yet a further aspect, tongue and groove joints together with adhesive are used to connect the frame members to one another. In addition, the base plate may be secured over a vacuum plate. The vacuum plate includes a passage through which vacuum may be supplied from the receiver to the interior of the box, for deforming a web of packaging material into the interior of the box in order to form a product-receiving cavity in the web. The vacuum plate includes an inlet that cooperates with a vacuum supply associated with the receiver. The vacuum plate has a layered construction, in which the layers are bonded together using an adhesive.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

The present invention will be described with respect to a food packaging machine and, more particularly, to a formation tool usable with a food packaging machine. However, it is understood that the invention may also be applicable with other food handling machines as well as non-food handling systems, such as packaging systems for packaging pharmaceutical products or any other product that is suitable for packaging between a pair of sealed webs.

Figure 1:
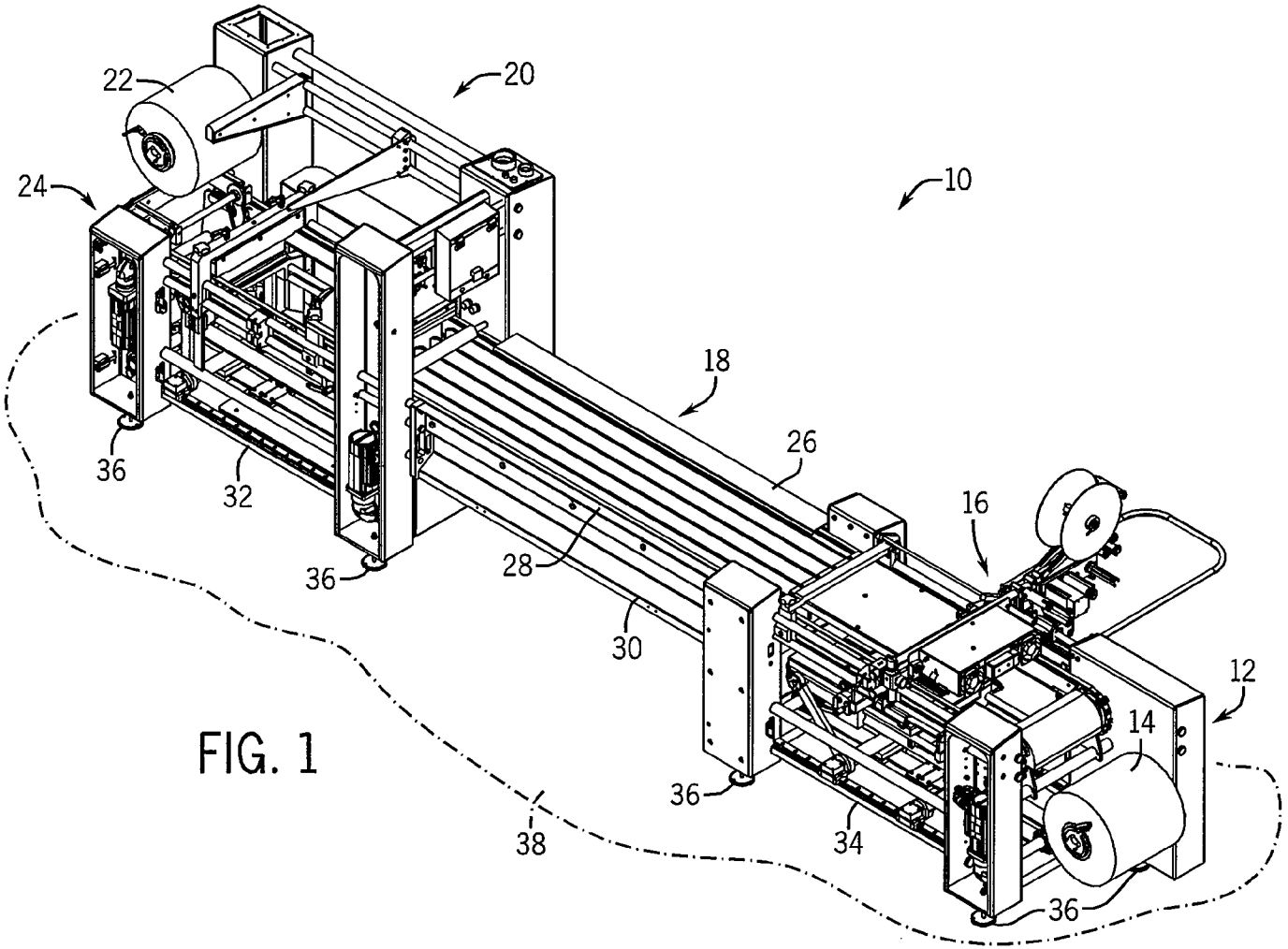
FIG. 1 is an isometric view of a packaging system incorporating an adhesively constructed tooling component assembly in accordance with one aspect of the invention.

FIG. 1 illustrates a food packaging machine 10 that generally includes a lower web supply station 12 for supplying a web of flexible web material from a supply roll 14 to a formation station 16. The web of flexible material is advanced to the formation station 16 at which cavities are formed in the web. The deformed web is then presented to a loading station 18 at which a user or machine loads products, e.g., hot dogs, cheese, etc., into the cavities formed in the sheet of web material. After product is loaded into the cavities, the sheet of web material is advanced to an upper web station 20 that supplies a web of flexible material from a supply roll 22. As is known in the art, the upper web of flexible material is placed atop the loaded cavities, and the upper and lower webs of material are presented to a sealing station 24, which may evacuate the loaded cavities, and seals the upper and lower webs of material together. As is known in the art, the sealing station 24 may include a heating assembly that heats the webs of flexible material to seal the upper web to the lower web of flexible material. The sealed packages may then be presented to a cutting station (not shown), labeling station (not shown), and bulk packaging station (not shown) as generally understood in the art. As further known in the art, the packaging machine 10 may also include a display unit (not shown) that presents a touch screen, for instance, to allow a user to control the food packaging machine 10 while proximate the loading station 18. It is noted that the packaging machine 10 may include various doors and covers (not shown) to limit access to the various moving parts of the machine 10 as known in the art.

Figure 2:
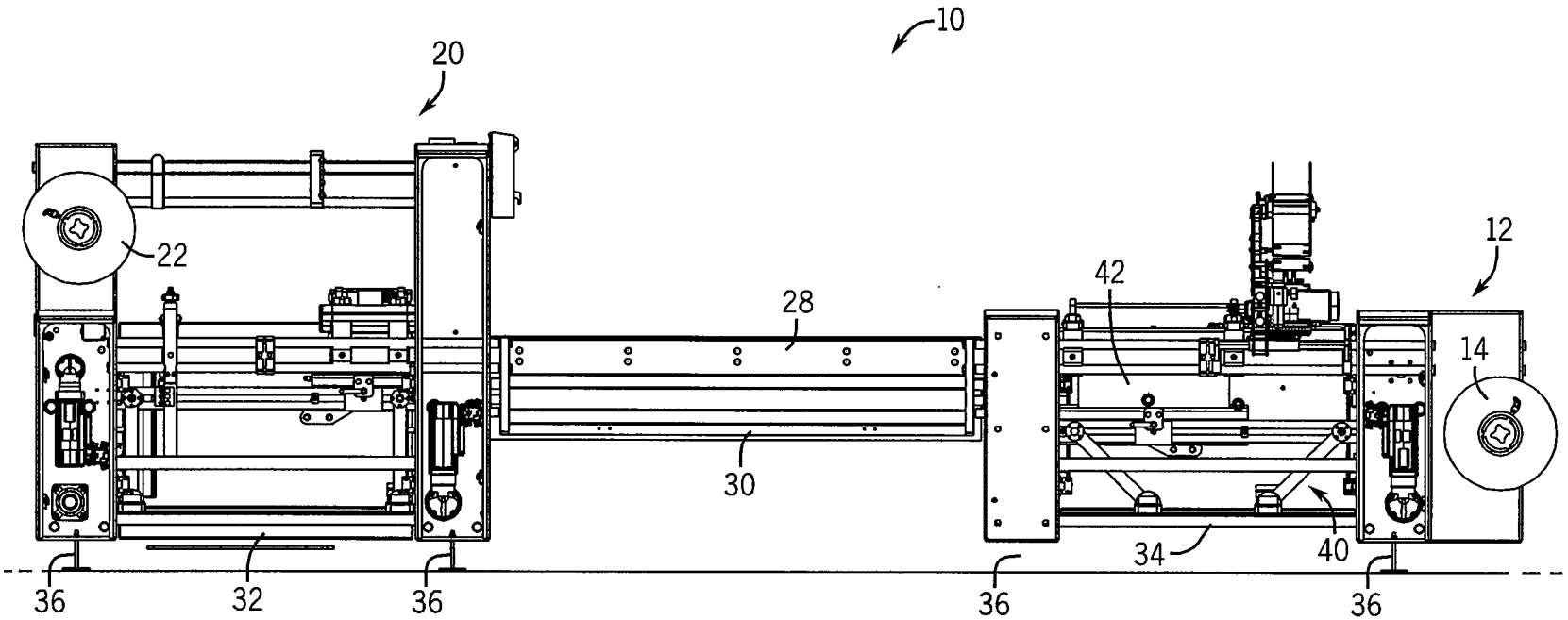
FIG. 2 is a front elevation view of the packaging system shown in FIG. 1.

With reference to FIG. 2, the various components of the food packaging machine 10 are supported by a frame assembly that includes a pair of spaced parallel upper frame members 26, 28 and lower spaced frame members such as shown at 30, 32, and 34. Legs 36 support the frame members in a raised position above floor 38. In a preferred embodiment, the frame members are joined using a suitable adhesive, such as described in copending U.S. patent application Ser. No. 12/246,915, the entire disclosure of which is incorporated herein by reference.

The formation station 16 includes a lift mechanism 40 that reciprocally moves a formation box 42 between a lowered position and a raised position. As is known in the art, the formation box 42 may have a set of dividers that define a set of cavities that may be evacuated using vacuum supplied from a vacuum pump (not shown) so as to draw the lower web material into the cavities. More particularly, when the formation box 42 is in its fully raised position, the formation box 42 contacts an underside of the lower web material. The cavities may then be evacuated to draw the lower web of flexible material downward into the cavities to form a deformed lower web of flexible material. It is recognized that stamps (not shown) may also be used to help force the lower web of flexible material into cavities so as to deform the lower web of flexible material. This process forms a number of cavities in the lower web that may be used for receiving product as described with respect to FIG. 1.

As known in the art, the formation box 42 is lowered and the deformed web material is advanced to the filling station 18 and thereafter to the finishing stations of the machine 10, such as the upper web station 20, the sealing station 24, and the cutting, labeling and bulk packaging stations. The upper web station 20 may include an evacuation box (not shown) that receives the filled lower web material. The upper web material is then placed atop the filled cavities whereupon the evacuation box is evacuated to draw the upper web material into contact with the lower web and evacuate the cavities. The pair of webs are then sealed, cut, labeled, etc.

The present invention will be described with respect to the formation box 42 for use with a packaging machine, such as that described with respect to FIGS. 1-2. It is understood, however, that the principles of the present invention may be used to construct an evacuation box or any other tooling components that are incorporated in the packaging machine.

Figure 3:
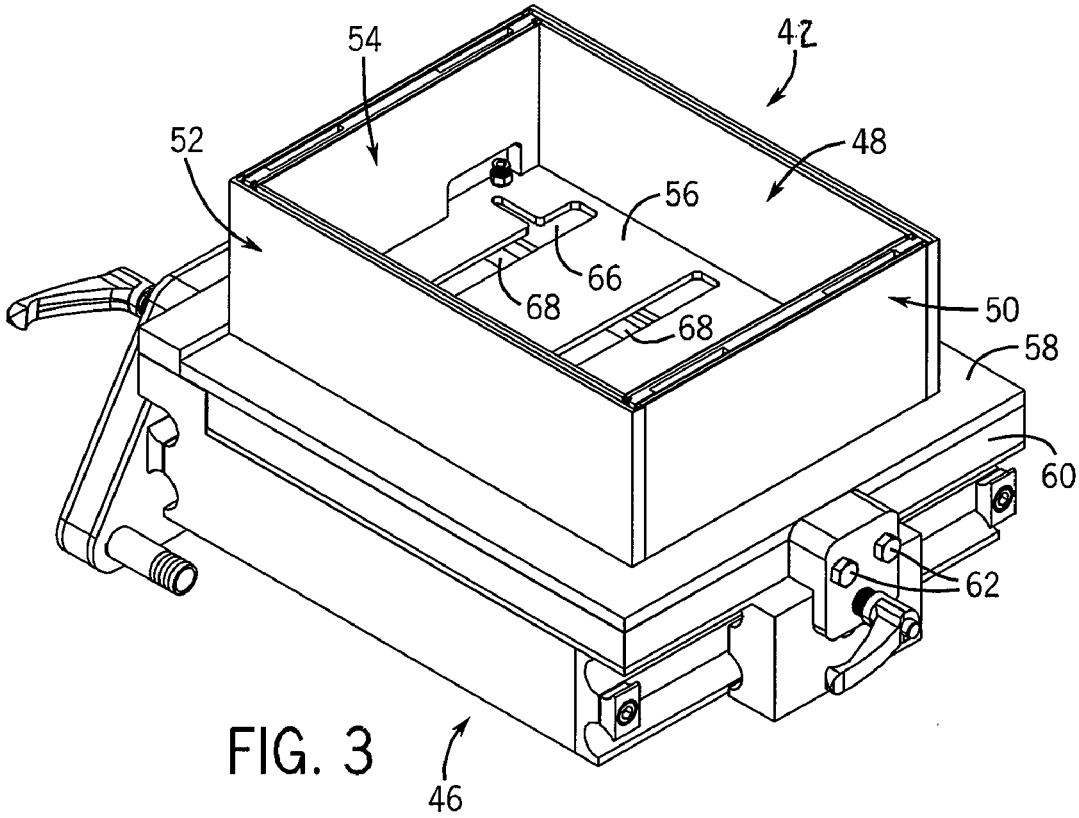
FIG. 3 is an isometric view of an adhesively constructed forming tooling component assembly incorporated into the packaging system shown in FIG. 1, in which the tooling component assembly is engaged with a receiver associated with the packaging system.
Figure 4:
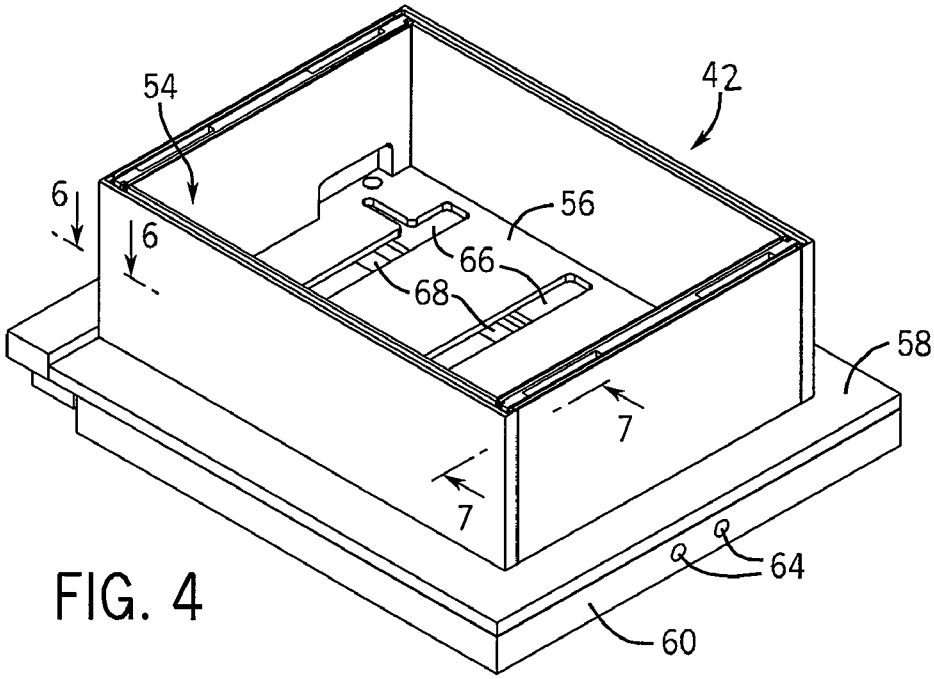
FIG. 4 is an isometric view of the tooling component assembly shown in FIG. 3.

Turning now to FIG. 3, the formation box 42 is shown mounted to a receiver 46 of packaging machine 10. In the illustrated embodiment, the formation box 42 has four wall panels 48, 50, 52, 54 connected together and supported by a base panel 56 to provide an opened-ended rectangular enclosure. The base panel 56 is seated on a planar support plate 58 that, in turn, is supported by a vacuum plate 60. The vacuum plate 60 is fastened to the receiver 46 by fasteners 62. The receiver 46 is secured within the packing machine 10 in a manner that is known. As shown in FIG. 4, the vacuum plate 60 has a pair of openings 64 formed in a side thereof into which the fasteners 62 are received to attach the formation box 42 to the receiver. The base panel 56 of box 42 includes a set of elongated openings 66 that communicate with transversely oriented slots 68 formed in the support plate 58. The elongated openings 66 communicate through slots 68 with vacuum recesses 70 formed in the vacuum plate 60.

Figure 5:
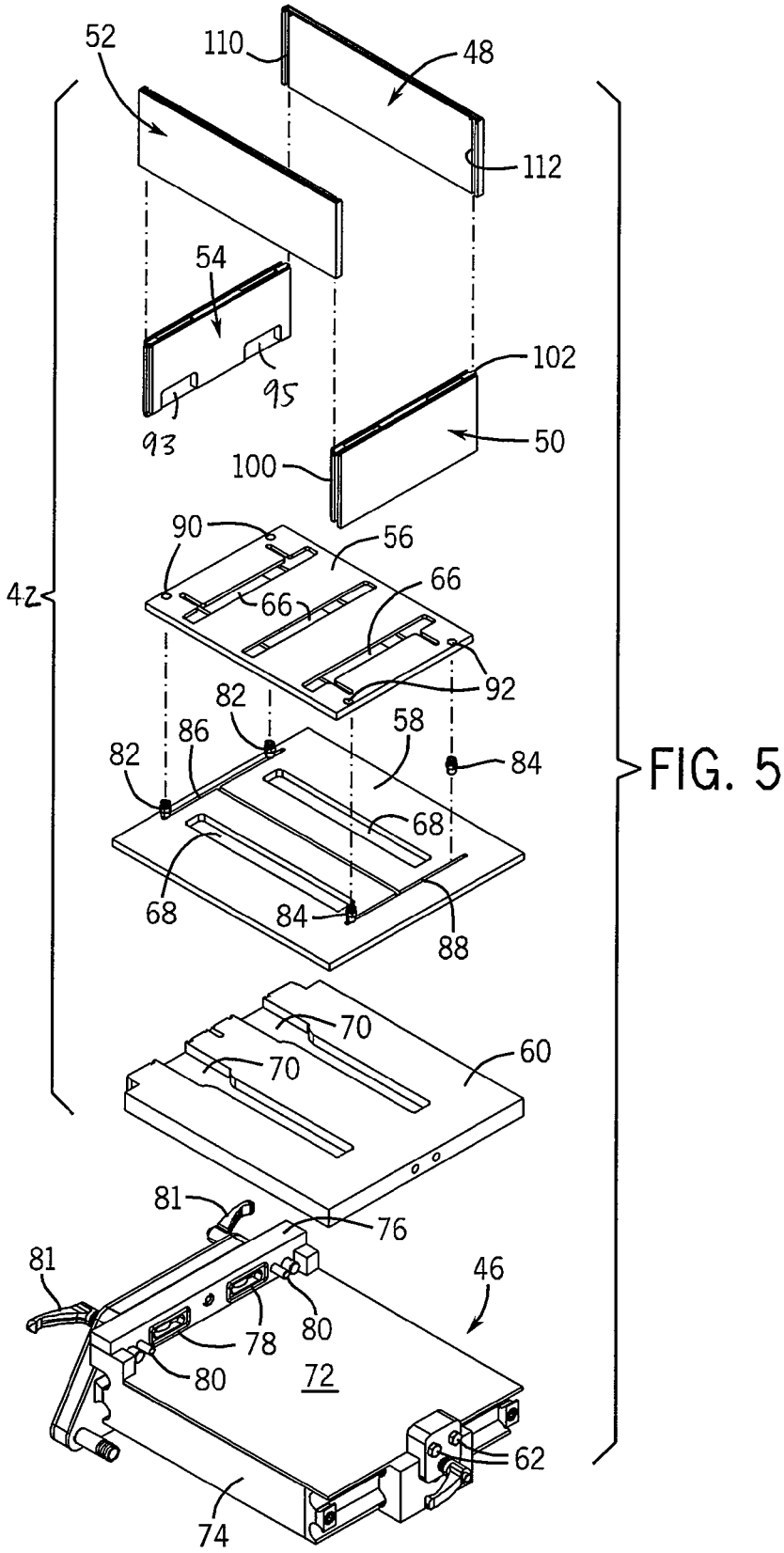
FIG. 5 is an exploded view of the tooling component assembly shown in FIG. 4.

As shown in FIG. 5, the receiver 46 provides a planar surface 72 supported by a mounting block 74. The mounting block 74 also supports a manifold 76 that provides a pair of vacuum ports 78 connected to a vacuum pump (not shown) via hoses (not shown) extending from the opposite side of the manifold 76. The vacuum ports 78 are thus fluidly connected with the elongated openings 66 of the base panel and the slots 68 of the support plate 58 for applying a negative pressure to the internal volume of the box 42. Adjacent the vacuum ports 78 are alignment pins or fasteners 80 to assist with proper placement of the vacuum plate 60 on the planar surface 72. The alignment pins or fasteners 80 may be retracted or extended by movement of levers 81. Proper alignment is necessary so that the vacuum ports 78 align and thus properly communicate with the vacuum recesses 70 formed in the vacuum plate 60.

The support plate 58 is adhesively affixed to the vacuum plate 60. Preferably, a thin sheet of adhesive is applied to either the top surface of the evacuation plate, the underside of the support plate 58, or both. The support plate 58 and the vacuum plate 60 are of equal length and width and, as such, the alignment of the support plate 58 and the vacuum plate 60 is straightforward. Nevertheless, it is preferred that the adhesive have a bonding time of sufficient length to allow fine adjustments, as needed, to the placement of the support plate 58 atop the vacuum plate 60.

Before the adhesive is applied, the vacuum recesses 70 of the vacuum plate 60 are filled with a blocking material, such as wax, to the top surface of the vacuum plate 60. If desired, the elongated slots 68 of support plate 58 may also be filled with a blocking material, such as wax. In this manner, when the adhesive is applied to the upper surface of vacuum plate 60 and/or the underside of support plate 58 and the vacuum plate 60 and support plate 58 are secured together, any excess adhesive that would otherwise drip or run into vacuum recesses 70 or elongated slots 68 comes into contact with the wax material in the recesses 70 and slots 68. After the adhesive has set and cured, the assembled vacuum plate 60 and support plate 58 are subjected to a sufficiently high temperature to melt in the wax material contained within the vacuum recesses 70 and slots 68. In this manner, the vacuum recesses 70 and slots 68 are free of adhesive that otherwise may make its way into the recesses 70 and slots 68 when the vacuum plate 60 and support plate 58 are adhesively secured together.

The support plate 58 includes a first pair and a second pair of upwardly extending dowels 82 and 84, respectively. Dowels 82 are slidable along a groove 86 whereas dowels 84 are slidable along a groove 88 spaced from and parallel to groove 86. The base panel 56 of the formation box 42 includes pairs of spaced openings 90 and 92 such that when the formation box 42 is fitted onto the support plate 58, the dowels 82 and 84 extend therethrough, respectively. The base panel 56 is preferably adhesively affixed to the support plate 58, which also may be accomplished using the lost wax process described above in connection with the adhesive securement of vacuum plate 60 and support plate 58. The combination of the dowels and the corresponding openings assist with aligning the base panel 56 to the support plate 58. Alternatively, the engagement of base panel 56 and support plate 58 may be accomplished using studs extending upwardly from support plate 58, in combination with threaded nuts that are engageable with the studs. In this regard, wall panels 50 and 54 include pockets, such as shown at 93, 95, which are configured to receive the dowels or fasteners that are used to align or connect base panel 56 to support plate 58. The pockets are sufficiently deep so that the dowels or fasteners do not extend past the inside surface of the panels 50 and 54, so as not to interfere with deformation of the web material into the interior of the formation box 42.

Figure 8:
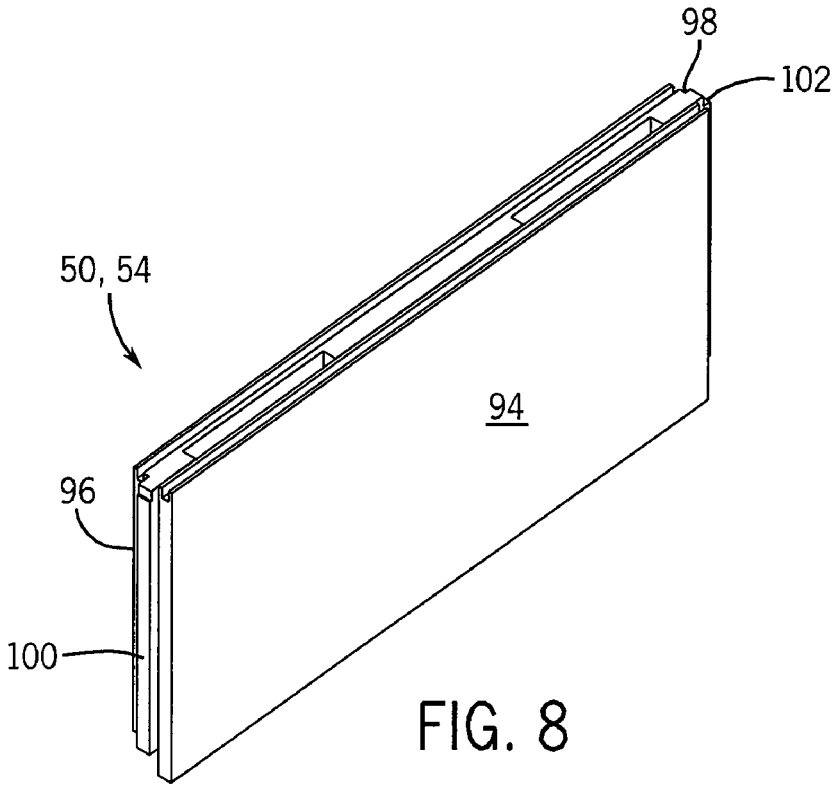
FIG. 8 is an isometric view of a tongued wall member of the tooling component assembly shown in FIG. 4.
Figure 9:
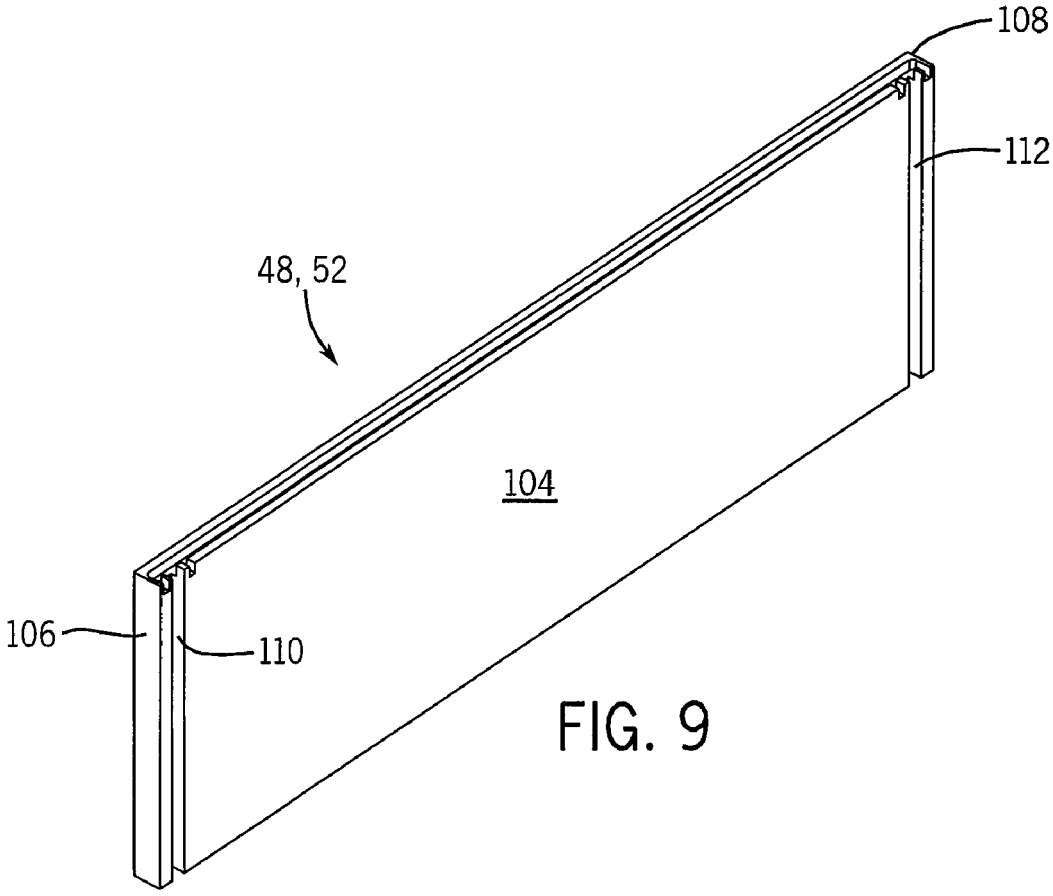
FIG. 9 is an isometric view of a grooved wall member of the tooling component assembly that engages with the tongued wall member shown in FIG. 8 according to one embodiment of the invention.

With additional reference to FIGS. 8 and 9, the wall panels 48, 50, 52 and 54 are interconnected in a series of adhesively enhanced tongue and groove connections. More particularly, wall panels 50 and 54 each have a planar body 94 defined by a pair of ends 96 and 98. Each end 96, 98 includes a tongue 100, 102, respectively. Wall panels 48 and 52 also have a planar body 104 defined by a pair of ends 106 and 108. Ends 106 and 108 have longitudinally extending grooves 110 and 112, respectively, which receive corresponding tongues of the wall panels 50 and 54. As described above, adhesive may be used to securely connect the tongue and groove connections.

Figure 6:
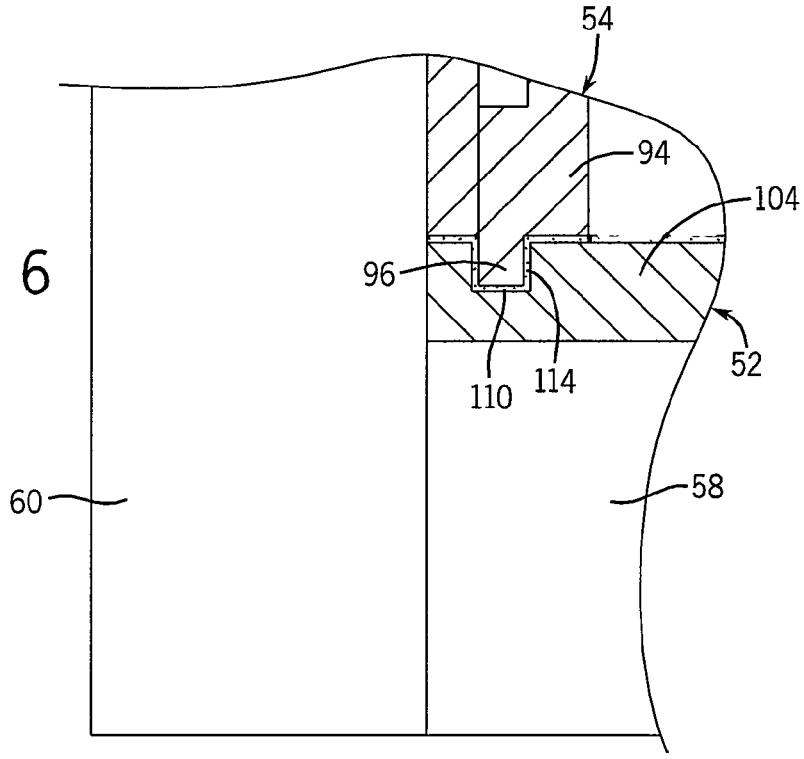
FIG. 6 is a partial section view of the tooling component assembly taken along line 6-6 of FIG. 4.
Figure 7:
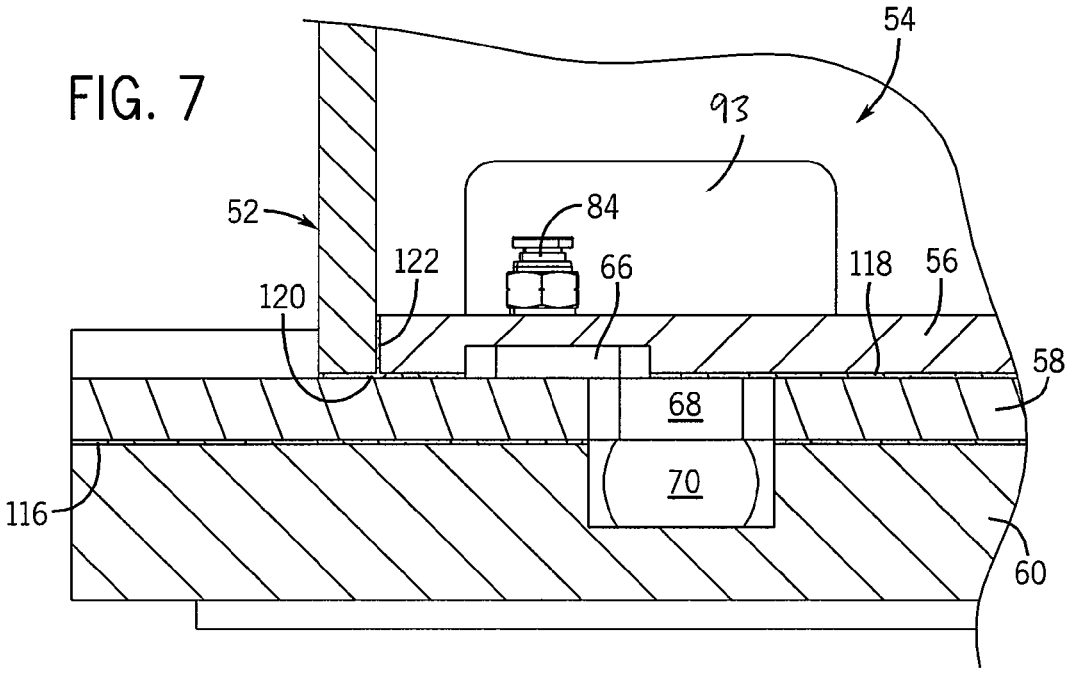
FIG. 7 is a partial section view of the tooling component assembly taken along line 7-7 of FIG. 4.

FIGS. 6 and 7 illustrate the adhesive bonding that is used to attach the various components of the formation box 42 to one another. Specifically, an adhesive bond 114 is used to interconnect the wall panels to one another. Similarly, various adhesive bonds are used to interconnect the base panel 56, support plate 58, and the vacuum plate 60. More particularly, adhesive is used to bond the support plate 58 to the vacuum plate 60 such that an adhesive layer 116 is formed therebetween. Similarly, adhesive is used to bond the base panel 56 to the support plate 58 such that an adhesive layer 118 is formed therebetween. Adhesive is also used to attach the wall panels to the base panel 56. For example, an adhesive bond 120 is made between wall panel 52 and the base panel 56. Similarly, adhesive 122 is used to attach the lower ends of the wall panels, e.g., wall panel 52 to the lower end of an adjacent wall panel, e.g., wall panel 54.

It is contemplated that a number of different adhesives may be used to for the aforementioned adhesive bonds, but it is preferred that an adhesive, such an epoxy, be used that is water resistant. It also desirable that the adhesive bonds maintain their integrity when exposed to cleaning and sterilizing agents.

It is understood that the principles of the formation box 42 heretofore described can be applied to the construction of an evacuation formation box. More particularly, using adhesive rather than conventional mechanical fasteners is particularly advantageous in reducing the collection of bacteria and other germs, as well as cleaning residue on the surfaces of the evacuation box.

Various alternatives and embodiments are contemplated as being within the scope of the following claims particularly pointing out and distinctly claiming the subject matter regarded as the invention.

I claim:

1. A web forming apparatus for use with a packaging machine in which a web of deformable material is formed into a series of packages, each of which has a pocket adapted for packaging a product, comprising:

a support member configured to be coupled to a receiver forming a part of the packaging machine;

a forming box coupled to the support member, wherein the forming box comprises a series of wall members coupled to a base member, and wherein the base member is secured to the support member, wherein the series of wall members have inwardly facing surfaces and the base member has an upwardly facing surface that together with the inwardly facing surfaces of the wall members define an interior volume having an open top, wherein the forming box is adapted for movement by the receiver of the packaging machine into contact with the web such that the web is positioned over the open top of the interior volume, wherein the web is subsequently drawn into the interior volume and into contact with the upwardly facing surface of the base member to form the pocket in the web adapted to receive the product to be packaged; and wherein the base member of the box is coupled to the support member by a bonding agent.

2. The web forming apparatus of claim 1 wherein the bonding agent is an adhesive.

3. The web forming apparatus of claim 2 wherein the adhesive is a water resistant epoxy.

4. The web forming apparatus of claim 1 wherein the series of wall members includes first, second, third, and fourth wall members generally arranged and coupled to the base member such that the open top has a rectangular shape.

5. The web forming apparatus of claim 1 wherein adjacent wall members are coupled together by a bonding agent.

6. The web forming apparatus of claim 5 wherein each wall member includes a first side edge and a second side edge opposite of and parallel to the first side edge, and wherein the first side edge and the second side edge of two of the wall members include a tongue and wherein the other two of the wall members have grooves for receiving the tongues.

7. The web forming apparatus of claim 1 wherein the support member comprises a support plate that is secured to a vacuum member via a bonding agent, wherein the vacuum member is configured for engagement with the receiver of the packaging machine and is adapted to receive vacuum from the receiver through a vacuum supply arrangement forming a part of the packaging machine.

8. The web forming apparatus of claim 7 wherein the base member has a first set of slots and wherein the support plate has a second set of slots that communicate with the first set of slots, wherein the vacuum member communicates vacuum to the interior volume of the box through the first set of slots of the base member and the second set of slots of the support plate.

9. The web forming apparatus of claim 7 further comprising engagement means for connecting the base member and the support plate.

10. A web material forming structure for use with a packaging machine in which a web of deformable material is formed into a series of packages, each of which has a pocket adapted for packaging a product, comprising:

a forming box having a base member having an upwardly facing surface and a plurality of upright wall members that extend from the base member and define inwardly facing surfaces which together with the upwardly facing surface of the base member collectively define an interior volume having an open top;

bonding agent joints interconnecting the upright wall members to the base member and bonding agent joints interconnecting adjacent upright wall members to each other; and a support member configured to be coupled to a receiver forming a part of the packaging machine, wherein the base member of the box is coupled to the support member by a bonding agent;

wherein the forming box is adapted for movement by the receiver of the packaging machine into contact with the web such that the web is positioned over the open top of the interior volume, wherein the web is subsequently drawn into the interior volume and into contact with the upwardly facing surface of the base member to form the pocket in the web adapted to receive the product to be packaged.

11. The web material forming structure of claim 10 wherein the bonding agent is an epoxy.

12. The web material forming structure of claim 10 further comprising an evacuation member adhesively coupled to a bottom surface of the support member and configured to engage the receiver of the packaging machine.

* * * * *